US005397177A

United States Patent [19]

Swisher, Jr.

[11] Patent Number: 5,397,177

[45] Date of Patent: Mar. 14, 1995

[54] ASPHALT PRODUCTION PLANT HAVING A TWO-BURNER DRYER WITH INCREASED EXHAUST CAPACITY

[76] Inventor: George W. Swisher, Jr., 1500 Dorchester Dr., Oklahoma City, Okla. 73120

[21] Appl. No.: 829,860

[22] Filed: Feb. 3, 1992

[51] Int. Cl.[6] ..... B28C 5/46

[52] U.S. Cl. ..... 366/25; 366/15; 366/40

[58] Field of Search ..... 34/10, 85, 135–137; 285/236; 366/3–7, 10–12, 14, 15, 22–25, 40, 144; 432/105, 108, 110, 111, 118

[56] References Cited

U.S. PATENT DOCUMENTS

| | | | |
|---|---|---|---|
| 2,290,765 | 7/1942 | Overman | 34/135 |
| 2,533,852 | 12/1950 | Tietig | 366/3 |
| 3,614,071 | 5/1970 | Brock | 259/147 |
| 3,693,945 | 9/1972 | Brock | 259/146 |
| 3,802,582 | 4/1974 | Brock | 214/17 |
| 3,809,373 | 5/1974 | Brock | 295/154 |
| 3,866,888 | 2/1975 | Dydzyk | 366/25 |
| 3,874,523 | 4/1975 | Brock et al. | 214/17 |
| 4,075,710 | 2/1978 | Jakob et al. | 366/25 |
| 4,106,114 | 8/1978 | Moore | 366/144 |
| 4,143,972 | 3/1979 | Benson | 366/25 |
| 4,147,436 | 4/1979 | Garbelman | 366/25 |
| 4,174,181 | 11/1979 | Garbelman | 366/2 |
| 4,293,228 | 10/1981 | Swisher, Jr. | 366/25 |
| 4,298,287 | 11/1981 | McCarter | 366/25 |
| 4,309,113 | 1/1982 | Mendenhall | 366/25 |
| 4,318,620 | 3/1982 | Maliper et al. | 366/25 |
| 4,361,406 | 11/1982 | Loggins, Jr. | 366/25 |
| 4,477,250 | 10/1984 | Brashears | 366/25 |
| 4,616,934 | 10/1986 | Brock | 366/4 |
| 4,715,720 | 12/1987 | Brock | 366/25 |
| 4,787,938 | 11/1988 | Hawkins | 106/281.1 |
| 4,797,002 | 1/1989 | Heap | 366/25 |
| 4,802,139 | 1/1989 | Sasaki | 366/25 |
| 4,946,283 | 8/1990 | Musil | 366/25 |
| 4,974,334 | 12/1990 | Roddewig | 34/10 |
| 4,989,986 | 2/1991 | Swisher | 366/25 |
| 4,991,879 | 2/1991 | Miller | 285/236 |
| 5,090,813 | 2/1992 | McFarland | 366/23 |
| 5,174,650 | 12/1992 | McFarland | 366/25 |

FOREIGN PATENT DOCUMENTS

| | | | |
|---|---|---|---|
| 227622 | 5/1959 | Australia . | |
| 666115 | 11/1937 | Germany | 34/135 |

OTHER PUBLICATIONS

Brock, J. Don, "Energy Conservation on Asphalt Plants", Copyright 1980.

*Primary Examiner*—David A. Scherbel
*Assistant Examiner*—Terrence R. Till
*Attorney, Agent, or Firm*—Dunlap & Codding

[57] ABSTRACT

An asphalt production plant with a drum dryer having two burners and expanded exhaust gas exit area. The dryer has a rotatable dryer drum with an inlet end and a discharge end. A burner is positioned at each end of the dryer drum to produce a stream of hot gases both parallel with and counter to the movement of aggregate through the dryer drum. A dust chamber surrounds a medial dust section of the dryer drum. The dust section of the dryer drum communicates with the dust chamber through slots and perforated angle plates to produce an increased area for the exit of exhaust gases. In addition to the drum dryer, the plant comprises an aggregate feed system for delivering aggregate into the dryer, an exhaust system, a drum mixer, a recycle feed system, a reservoir of bituminous fluid and an asphalt bin. A drag conveyor is provided to transfer aggregate from the dryer into the drum mixer. Recycle material and dust from the exhaust system may be introduced into the drag conveyor as well. Bituminous liquid is piped into the mixer drum from the reservoir. The drum mixer combines the aggregate, bituminous liquid and optional recycle material and dust to produce asphalt. An output conveyor moves the asphalt tom the mixer to an asphalt bin for distribution to transport trucks. Another preferred embodiment of the asphalt plant utilizes a mixing auger in place of the drum mixer.

13 Claims, 8 Drawing Sheets

ASPHALT PRODUCTION PLANT HAVING A TWO-BURNER DRYER WITH INCREASED EXHAUST CAPACITY

FIELD OF THE INVENTION

The present invention relates to hot mix asphalt production plants and particularly to a hot mix asphalt plant utilizing a two-burner dryer drum with increased exhaust gas capacity.

SUMMARY OF THE INVENTION

An asphalt production plant constructed in accordance with the present invention comprises a dryer drum for removing moisture from virgin aggregate. The dryer drum has an inlet end, a discharge end and an axis of rotation extending from the inlet end to the discharge end. A drive system is provided to rotate the dryer drum about the axis of rotation of the dryer. A parallel burner is located at the inlet end of the dryer drum and a counterflow burner is positioned at the discharge end of the dryer drum.

A dust chamber surrounds a medial dust section of the dryer drum. The exhaust gas exit area from the interior of the dryer drum to the dust chamber is augmented by dryer drum slots which are covered by perforated angle plates.

An aggregate feed system stores aggregate and feeds aggregate into the inlet end of the dryer drum. Dry aggregate is transferred out of the discharge end of the dryer drum into either a mixing auger or a drag conveyor feeding a mixer drum. Within the mixer drum or mixing auger, the aggregate is mixed with a bituminous liquid to produce the asphalt product.

A recycle feed system is provided to introduce recycle material into the asphalt mix. Recycle material includes, but is not limited to, asphalt product which has been previously laid and then reclaimed.

An exhaust system is connected to the dust chamber to draw exhaust gases from the dryer drum and to remove dust entrained in the exhaust gases. The dust collected by the exhaust system may be introduced into the asphalt mix by a screw conveyor or a pneumatic system.

The new asphalt product is discharged from the mixer drum or mixing auger and conveyed to an asphalt bin for loading into transport trucks.

In conventional drum mix plants, productivity decreases as the moisture content of the aggregate increases. An object of the present invention is to provide an apparatus which can maintain tons per hour production even when the moisture content rises.

Another object of this invention is to provide an apparatus with more efficient and complete fuel combustion than that of conventional asphalt production plants.

Yet another object of the present invention is to provide an asphalt production plant which removes dust and pollutants from exhaust gases to meet environmental constraints while maintaining a high level of production capacity.

Other objects and advantages of the present invention will be apparent from the following detailed description when read in conjunction with the accompanying drawings and appended claims.

BRIEF DESCRIPTION OF THE DRAWINGS

FIG. 6 is a perspective view of one of the veiling flights of the dryer drum of FIG. 4.

DETAILED DESCRIPTION OF THE PREFERRED EMBODIMENTS

Figure 1:
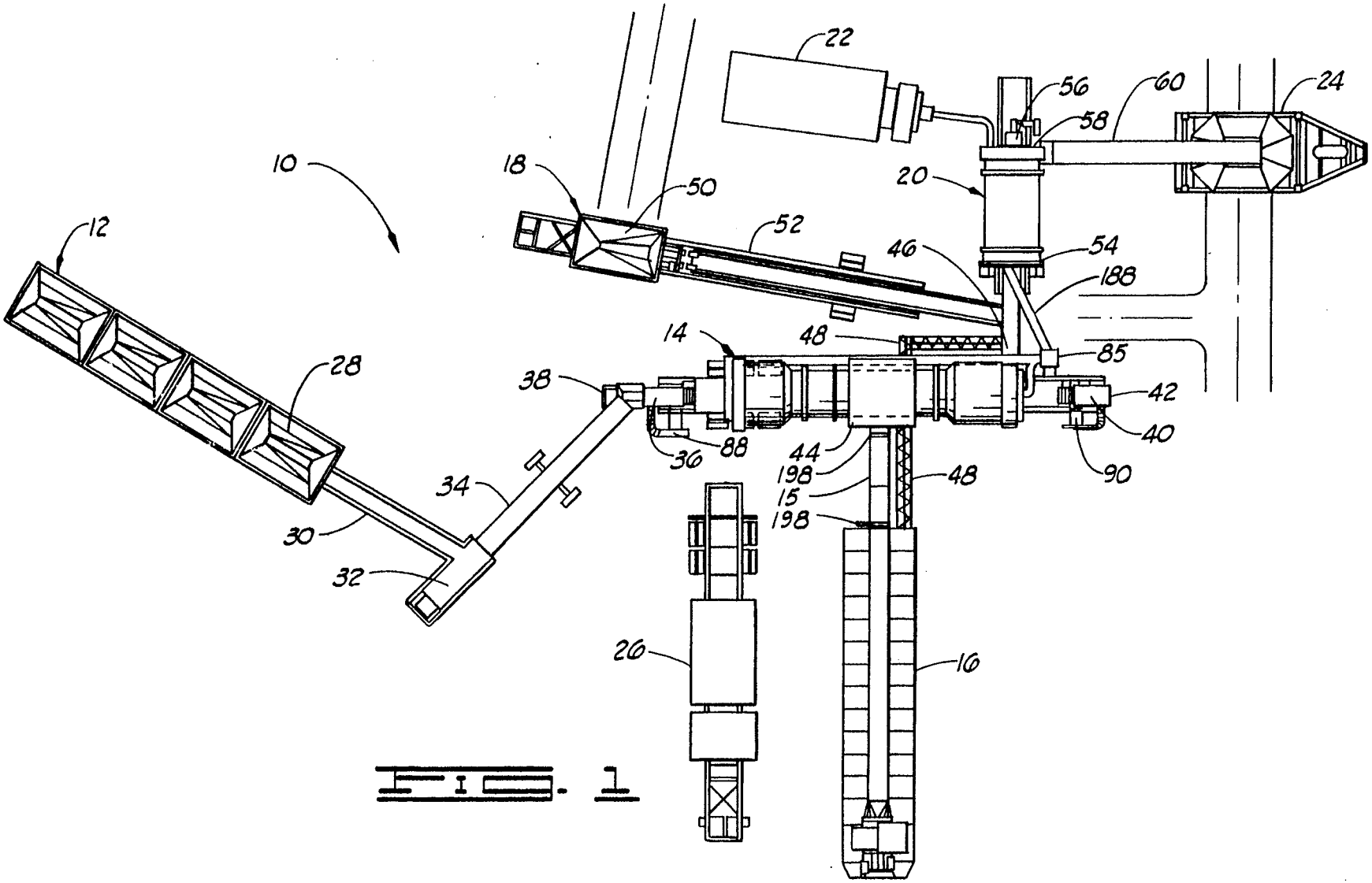
FIG. 1 is a plan view of an asphalt production plant constructed in accordance with the present invention.

Referring now to the drawings in detail and to FIG. 1 in particular, reference numeral 10 generally designates an asphalt production plant constructed in accordance with the present invention. The major components of the asphalt plant 10 include an aggregate feed system 12, a drum dryer 14, an exhaust system or "baghouse" 16, a recycle feed system 18, a drum mixer 20, a bituminous liquid reservoir 22 and an asphalt bin 24. FIG. 1 also illustrates a control house 26, which may be provided for monitoring and controlling the functions of the plant 10.

The aggregate feed system 12 includes a plurality of cold feed bins. One of the cold feed bins is designated by reference numeral 28 and is generally representative of the cold feed bins. A conveyor 30 is provided to transfer aggregate from the cold feed bins to a vibrating screen 32. The vibrating screen 32 allows only aggregate smaller than a predetermine size to proceed further in the aggregate feed system 12. Aggregate passing through the screen 32 continues to a second conveyor 34, which transfers aggregate into the drum dryer 14.

The drum dryer 14 includes a parallel burner 36 at the inlet end 38 of the dryer 14 and a counterflow burner 40 at the discharge end 42 of the dryer 14. A dust chamber 44 is located around a medial portion of the dryer 14. The drum dryer 14 removes moisture from the aggregate and discharges the aggregate to a drag conveyor 46 at the discharge end 42 of the dryer 14.

The conventional exhaust system 16 is connected to the dust chamber 44 of the dryer 14 by a connecting duct 15. The exhaust system 16 or "baghouse" receives exhaust gases from the dryer 14 and removes dust particles which are entrained in the gases. The dust which is collected may be disposed of outside the plant or may be introduced into the mixer 20 as a component of the asphalt product. A dust screw conveyer 48 may extend from the baghouse 16 to the drag conveyor 46 to transfer dust from the baghouse 16 for introduction into the mixer 20. As an alternative to the dust screw conveyor 48, a pneumatic system may be used to blow dust from the baghouse 16 directly into the mixer 20.

The recycle feed system 18 includes at least one recycle feed bin 50, which contains recycle material for use with the aggregate in the production of hot mix asphalt. The recycle material includes, but is not limited to, previously laid asphalt which has been reclaimed. A recycle conveyor 52 carries recycle material from the recycle feed bin 50 into the drag conveyor 46 for introduction into the mixer 20.

The drag conveyor 46 feeds aggregate into the inlet end 54 of the drum mixer 20, and may also feed recycle material and dust into the mixer 20. In addition to these materials, the reservoir 22 of bituminous liquid is adapted to introduce bituminous liquid into the drum mixer 20. A burner 56 is located at the discharge end 58 of the mixer 20. The mixer 20 heats and mixes the aggregate and bituminous liquid, and optional recycle material and dust, to produce the hot mix asphalt product.

The asphalt product is discharged from the mixer 20 at the discharge end 58 of the mixer 20 to a second drag conveyor 60 which transfers the asphalt product to the asphalt bin 24. The asphalt bin 24 delivers the asphalt product to trucks for transporting the asphalt product to the asphalt-laying job-site. The asphalt bin 24 typically has an elevated discharge chute for gravity feed of the asphalt into a truck driven under the asphalt bin 24. An acceptable asphalt bin 24 is disclosed in U.S. Pat. No. 3,802,582 issued Apr. 9, 1974 to Brock, which is hereby incorporated by reference.

Figure 2:
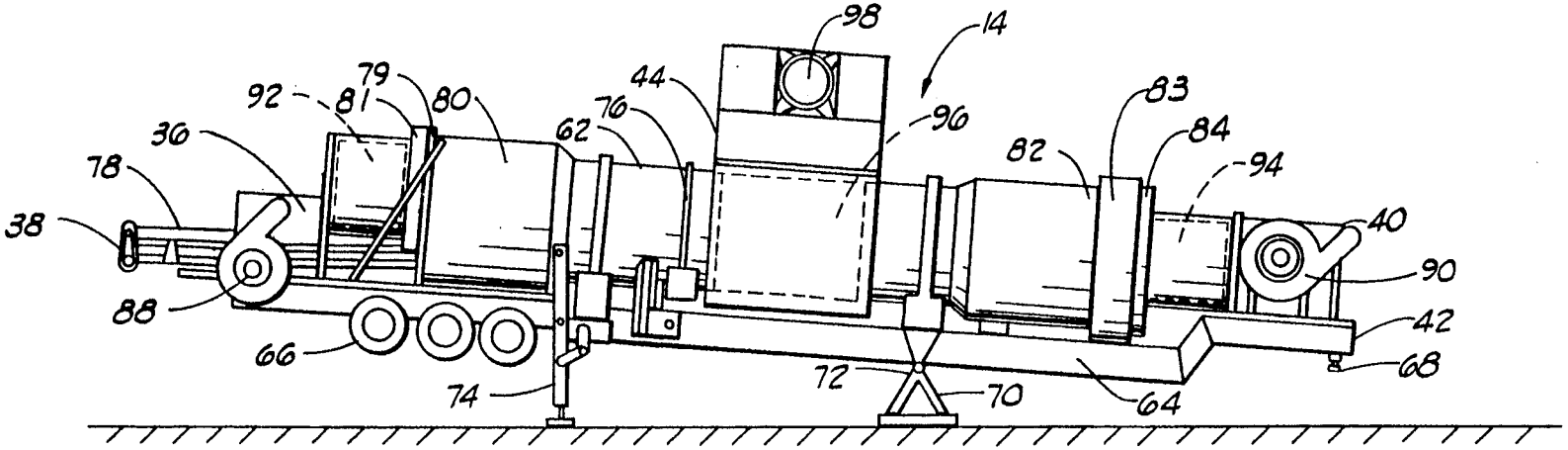
FIG. 2 is a side elevation of the dryer of FIG. 1.
Figure 3:
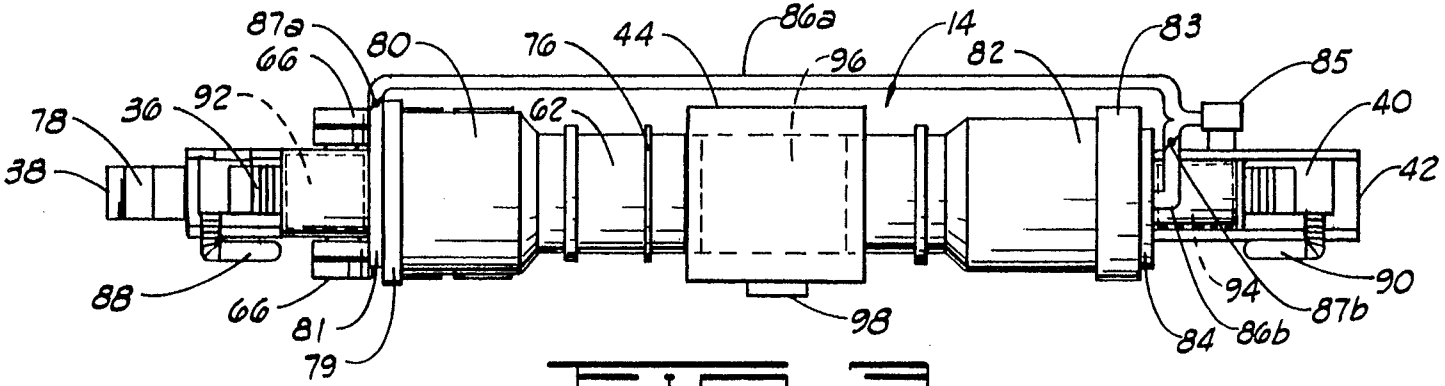
FIG. 3 is a top plan view of the dryer of FIG. 1.

FIGS. 2 and 3 illustrate the drum dryer 14 separate from the balance of the asphalt production plant 10. As disclosed hereinabove, the parallel burner 36 of the dryer 14 is located at the inlet end 38 of the dryer 14 and the counterflow burner 40 is positioned at the discharge end 42 of the dryer 14. The dryer 14 comprises a cylindrical drum 62 rotatably mounted on a frame 64. The inlet end of the frame 64 is equipped with three axles and wheels 66 for transporting the dryer 14. The discharge end of the frame 64 has a hitch 68 for attachment of the frame 64 to a vehicle for hauling the dryer 14 from one location to another. A support stand 70 on each side of the dryer 14 (only one of which is shown) receives a trunnion 72 attached to the frame 64 to support the dryer 14 and to allow the dryer 14 to pivot upon the support stands 70.

A hydraulic leg assembly 74 (only one of which is shown) is attached to each side of the dryer frame 64. The hydraulic legs 74 are operationally connected to controls in the control house 26 to adjust the slope of the dryer drum 62 from the inlet end 38 to the discharge end 42, even while the dryer 14 is operating. The operating grade of the dryer 14 is generally about $\frac{3}{4}$-inches to $\frac{5}{8}$-inches fall per foot with the inlet end 38 higher than the discharge end 42. The degree of inclination of the dryer 14 is used to control the length of time that aggregate is resident within the dryer drum 62. The slope of the dryer 14 is also important in controlling the density of the cascades of aggregate within the dryer drum 62 to obtain a proper rate of moisture removal from the aggregate regardless of the volume of aggregate being dried. A conventional motor with chain and sprocket assembly 76 drives rotation of the dryer drum 62 about its longitudinal axis and is monitored and controlled from the control house 26.

A slinger feeder assembly 78 is positioned at the inlet end 38 of the dryer 14 and extends into an intake breeching assembly 79 communicating with an inlet area 80 of the dryer drum 62. The slinger feeder assembly 78 conveys aggregate into the intake breeching assembly 79 for transfer into the inlet area 80 of the dryer drum 62. An inlet end return plenum 81 communicates with the intake breeching assembly 79.

Toward the discharge end 42 of the dryer 14, discharge area 82 of the dryer drum 62 communicates with a discharge breeching assembly 83 for delivering the aggregate out of the dryer drum 62. A discharge end return plenum 84 communicates with the discharge breeching assembly 83. As best shown in FIG. 3, a return fan 85 is mounted to the dryer frame 64 near the discharge end 42. A dryer return duct **86*a* extends from the return fan 85 to the inlet end return plenum 81. Another dryer return duct 86*b* extends from the return fan 85 to the discharge end return plenum 84. The dryer return duct 86*a* returns exhaust gases from the mixer 20 into the inlet area 80 of the dryer drum 62 through the inlet end return plenum 81. Similarly, the dryer return duct 86*b* returns exhaust gases from the mixer 20 into the discharge area 82 of the dryer drum 62 through the discharge end return plenum 84. A return damper 87*a* is mounted within the dryer return duct 86*a* and another return damper 87*b* is mounted within the dryer return duct 86*b* to adjust the flows of mixer exhaust gases to each end of the dryer drum 62**.

Continuing to refer the FIGS. 2 and 3, the dryer 14 includes the parallel burner 36 at the inlet end 38 and the counterflow burner 40 at the discharge end 42. Each dryer burner 36 and 40 is typically rated between 50 and 150 million BTUs capacity. The BTU rating of the dryer burners 36 and 40 may be varied depending upon the operating requirements of the particular asphalt production site. Each burner 36 and 40 is equipped with a combustion fan assembly 88 and 90 and directs a flame into a corresponding refractory-lined combustion chamber 92 and 94. The combustion chambers 92 and 94 extend around the length of the flame of the corresponding burner 36 and 40 between the flame and the inner periphery of the dryer drum 62. Each combustion chamber 92 and 94 has an open end opposite the respective burner 36 and 40. Hot gases stream from the flame of each burner 36 and 40 through the open end of the respective combustion chamber 92 and 94 toward the dust chamber 44 of the dryer 14.

As disclosed hereinabove, the dust chamber 44 surrounds the dryer 14. A dust section 96 (indicated by dashed lines in FIGS. 2 and 3) of the dryer drum 62 is circumscribed by the dust chamber 44. The upper end of the dust chamber 44 includes an exhaust duct 98 which communicates with the exhaust system 16.

Figure 4:
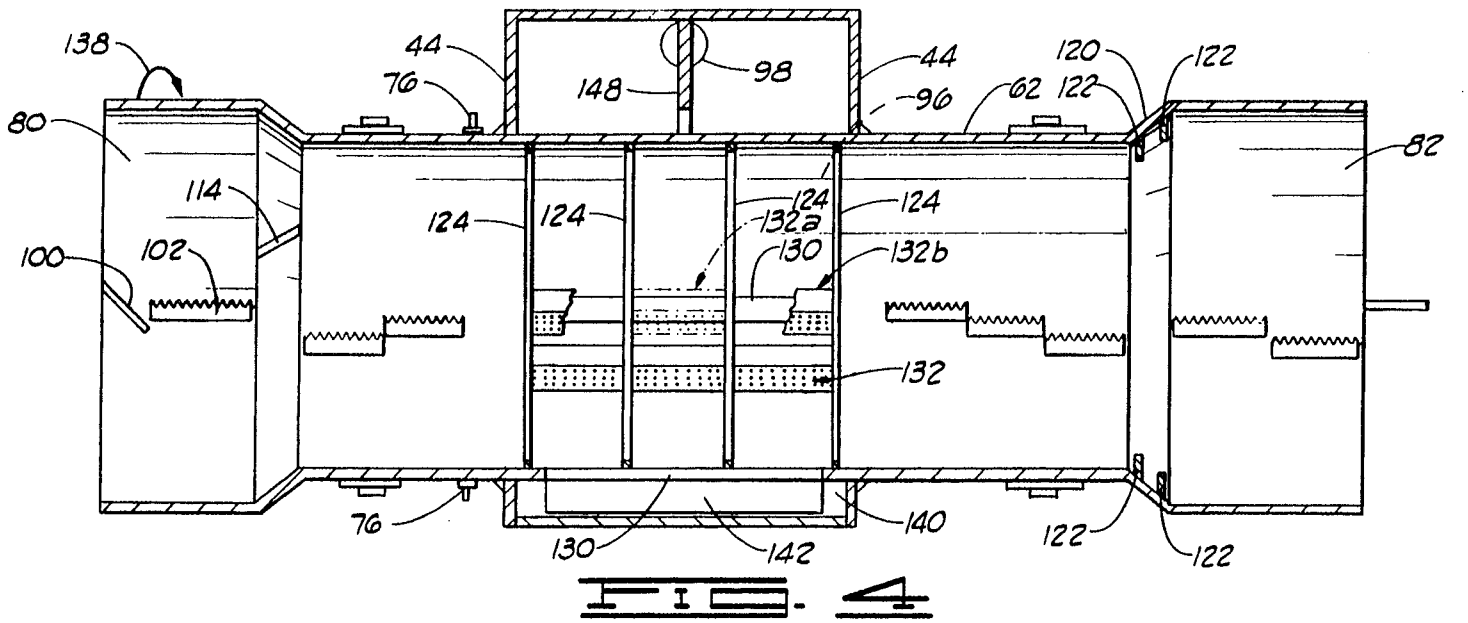
FIG. 4 is a partly diagrammatical, longitudinal cross-sectional view of the dryer drum of FIG. 1.

Referring now to FIG. 4, the interior of the dryer drum 62 is shown in detail. It should be appreciated that various dimensions of FIG. 4 are exaggerated for purposes of illustration. A plurality of spiral flights extend from the inner periphery of the dryer drum 62 at the inlet end of the dryer drum 62. One of the spiral flights is designated by reference numeral 100 and is generally representative of the spiral flights. Each spiral flight 100 is a straight plate which is attached to the inner periphery of the dryer drum 62 at an angle. The angle of the spiral flights 100 serves to lift the aggregate into the dryer drum 62 as the aggregate is initially introduced into the dryer drum 62. While only one spiral flight 100 is shown in FIG. 4 for clarity of illustration, it is typical that approximately twenty-six equally spaced spiral flights 100 extend inward from the inner periphery of the dryer drum 62. The number of spiral flights 100 is variable and may differ according to the diameter of the dryer drum 62 in question.

Moving toward the discharge area 82, the next series of flights attached to the inner periphery of the dryer drum 62 is a plurality of veiling flights. One of the veiling flights is designated by reference numeral 102 and is generally representative of the veiling flights. For purposes of clarity only one of the veiling flights 102 is shown in FIG. 4 for each series or band of veiling flights 102, but it is typical that approximately twenty-six equally spaced veiling flights 102 extend inward from the inner periphery of the dryer drum 62 in each series or band of veiling flights 102. The number of veiling flights 102 may be varied from one dryer drum 62 to another.

FIG. 6 shows one of the veiling flights 102 separately. The veiling flights 102 have a saw-tooth side 104 to rake through the aggregate and cause the aggregate to veil or cascade within the dryer drum 62 as the dryer drum 62 rotates. The mounting side 106 of each veiling flight 102 includes a plurality of bolt-holes for attachment of the veiling flight 102 to the inner periphery of the dryer drum 62. One of the bolt-holes is designated by reference number 108 and is generally representative of the bolt-holes in the veiling flights 102. An intermediate side 110 of each veiling flight 102 includes a plurality of cutouts. One of the cutouts is designated by reference numeral 112 and is generally representative of the cutouts in the veiling flights 102. The cutouts 112 allow aggregate dust to leak through the veiling flight 102 as the saw-tooth edge 104 of the veiling flight 102 cascades the aggregate. The leakage of aggregate through the cutouts 112 prevents voids in the aggregate veiling and promotes the desired density of aggregate across the dryer drum 62.

After the veiling flights 102 in the inlet area 80, the diameter of the dryer drum 62 diminishes. In this reducing area, a series of pan flights are secured to the inner periphery of the dryer drum 62. One of the pan flights is designated by reference numeral 114 and is generally representative of the pan flights of the dryer drum 62. Although for clarity only one pan flight 114 is shown in FIG. 4, it is typical that approximately 26 equally spaced pan flights 114 extend inward from the inner periphery of the dryer drum 62. The number of pan flights 114 may be varied from drum to drum.

Figure 5:
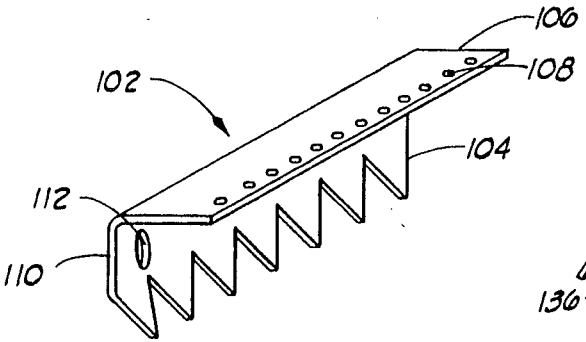
FIG. 5 is a perspective view of one of the pan flights of the dryer drum of FIG. 4.
Figure 5:
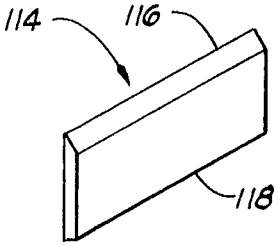

As shown in FIG. 5, each pan flight 114 is a straight plate with a flanged side 116 which points inward from the inner periphery of the dryer drum 62 to assist movement of the aggregate through the narrowing diameter of the dryer drum 62. The side 118 opposite the flanged side 116 of each pan flight is attached to the inner periphery of the dryer drum 62.

Referring back to FIG. 4, more veiling flights 102 are present between the pan flights 114 and the dust section 96 of the dryer drum 62. Additional series or bands of veiling flights 102 are located to the discharge side of the dust section 96 and in the discharge area 82 of the dryer drum 62. An increasing diameter section 120 leads into the discharge area 82 of the dryer drum 62. In this area 120, a plurality of damming rings 122 extend inward from the inner periphery of the dryer drum 62. The damming rings 122 cause a buildup of aggregate as the aggregate moves into the larger diameter area 82. The enlarging diameter area 120 is subject to more wear than areas of constant diameter and the aggregate buildup lines the inner periphery of the dryer drum 62 to reduce such wear.

Turning now to the dust section 96 of the dryer drum 62, four support rings 124 extend from the inner periphery of the dryer drum to provide additional strength and rigidity to the dust section 96 of the dryer drum 62. As disclosed hereinabove, the dust chamber 44 surrounds the dust section 96 of the dryer drum 62.

Continuing to refer to FIG. 4, a plurality of slots extend through the dryer drum 62 within the dust section 96. One of the slots is designated by reference numeral 130 and is generally representative of the slots through the dryer drum 62. Each slot 130 is covered by an angle plate 132 extending inward from the inner periphery of the dust section 96 of the dryer drum 62. One of the angle plates is designated by reference character 132 and is generally representative of the angle plates in the dust section 96 of the dryer drum 62. Another angle plate 132, designated by reference character **132*a*, is indicated in phantom lines to show the slot 130 underneath. A third angle plate 132, designated by reference character 132*b*, is shown partially cut away to show a portion of the slot 130** underneath.

Figure 7:
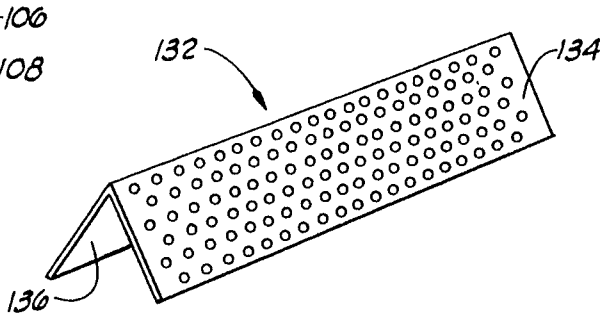
FIG. 7 is a perspective view of one of the angle plates of the dryer drum of FIG. 4.

As best shown in FIG. 7, one side 134 of each angle plate 132 is perforated and the other side 136 is solid. The perforated side 134 allows aggregate dust and gases to pass through the dryer drum 62 and into the dust chamber 44, while the solid side 136 lifts the aggregate as the dryer drum 62 rotates. The angle plates 132 are installed in the dust section 96 of the dryer drum 62 so that the solid side 136 is the leading side and the perforated side 134 is the trailing side as the dryer drum rotates. In FIG. 4, the direction of the dryer drum 62 rotation is indicated by direction arrow 138.

Some dust which enters the dust chamber 44 through the perforated side 134 of the angle plates 132 and the dryer slots 130 may be too heavy to remain entrained in the exhaust gases. This heavier dust falls to the lower end of the dust chamber 44 in a space 140 between the dryer drum 62 and the dust chamber 44. To pick up this heavier dust and introduce it back into the dryer drum 62, a wiper plate 142 extends from the outer periphery of the dryer drum 62 angularly toward the dust chamber 44. The slots 130 proximate to the wiper plate 142 are used as dust returns. One of the dust return slots is designated by reference character **130*d* in FIG. 8 and is generally representative of the dust return slots through the dryer drum 62 in the dust section 96. The angle plate 132 covering the dust return slot 130*d*, is generally represented by reference character 132*d* in FIG. 8. It should be understood that the perforations of the angle plates 132*d* are larger than the perforations of the other angle plates 132. The larger perforations are needed to prevent the perforations from becoming clogged by the dust returning to the interior of the dryer drum 62. The wiper plate 142 sweeps between the dryer drum 62 and the dust chamber 44 as the dryer drum 62 rotates to pick up dust and return the dust into the dryer drum 62 through the slots 130*d* and angle plates 132*d***.

Figure 8:
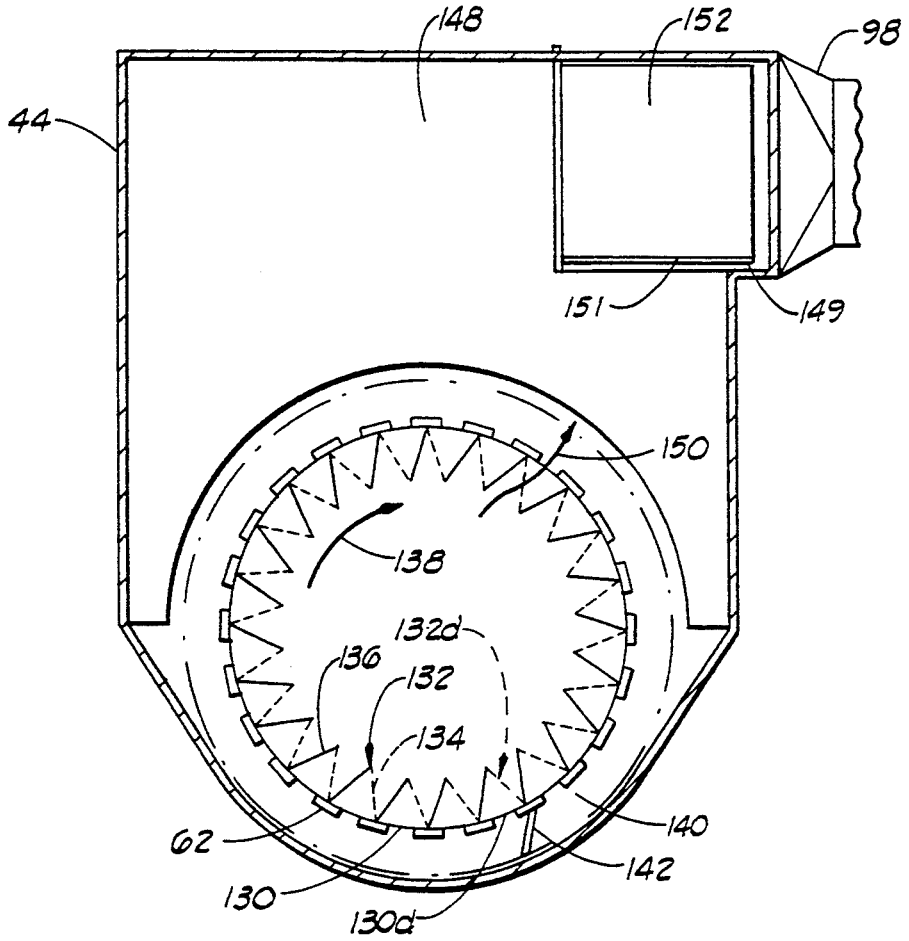
FIG. 8 is a partly diagrammatical, transverse cross-sectional view of the dust section of the dryer of FIG. 1.

FIG. 8 illustrates the rotation of the dryer drum 62 indicated by direction arrow 138), the flow of exhaust gases (indicated by direction arrow 150), and the return of dust from the space 140 between the dust chamber 44 and the dryer drum 62 back into the dryer drum 62 by the wiper plate 142.

Figure 9:
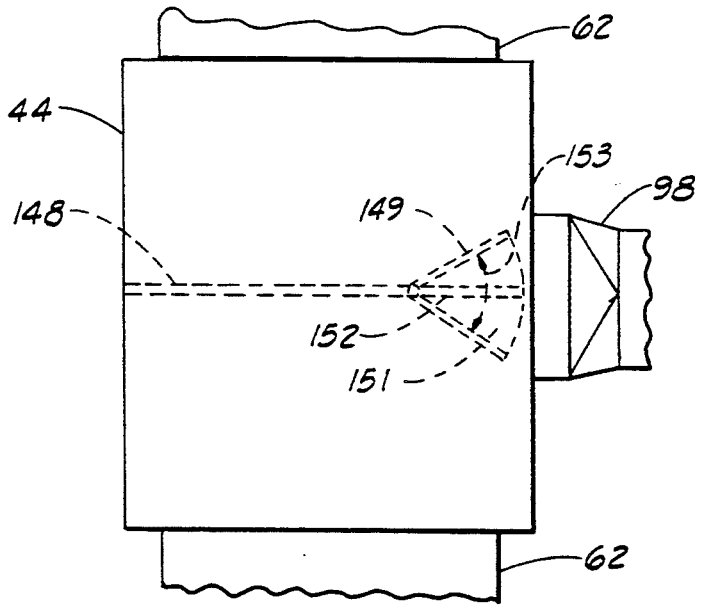
FIG. 9 is a top plan view of the dust section of the dryer of FIG. 1.

As shown in FIGS. 8 and 9, the upper portion of the dust chamber 44 is sectioned into two parts by a wall 148. A pivoting damper 149 is located in the wall 148 proximate to the exhaust duct 98. The damper 149 swings across the opening of the dust chamber 44 to the exhaust duct 98 to adjust exhaust gas flow from the parallel burner 36 relative to exhaust gas flow from the counterflow burner 40. Arrow 150 indicates the path of exhaust gas from the dryer drum 62 into the dust chamber 44 and on through the exhaust duct 98 to the exhaust system 16.

FIGS. 8 and 9 illustrate the construction of the damper 149 in the dust chamber 44. As shown in these figures, the damper 149 has a pie-shaped base 151 attached to a damper plate 152. The damper 149 is adapted to pivot as indicated by pivot arrow 153 to adjust the relative flow of exhaust gases from each end of the dryer drum 62 into the upper end of the dust chamber 44.

Figure 10:
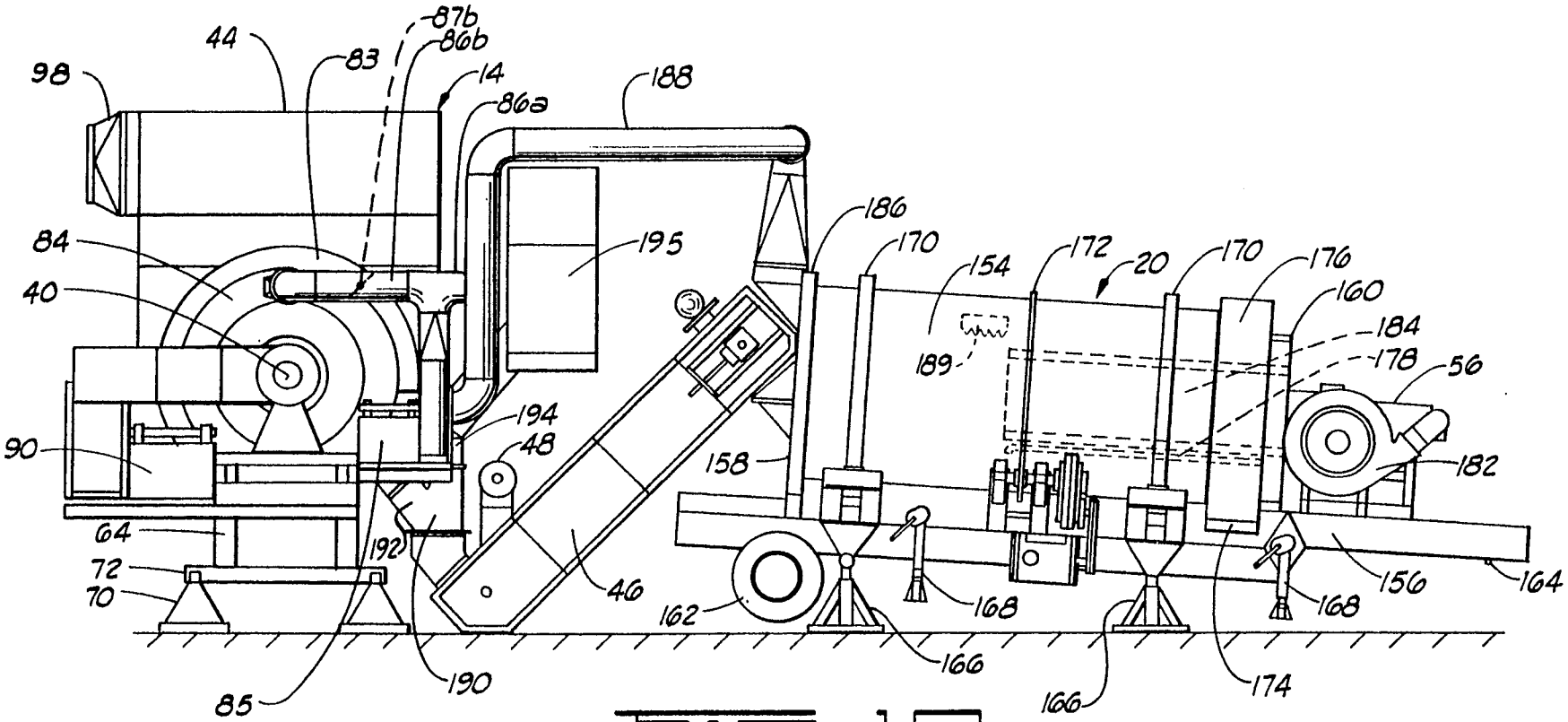
FIG. 10 is a side elevation of the mixer with an end view of the dryer of FIG. 1, illustrating the drag conveyor and the return duct between the mixer and the dryer.

Referring now to FIG. 10, the drum mixer 20 is shown in detail. The mixer 20 comprises a cylindrical mixer drum 154 mounted on a mixer frame 156. The mixer 20 has an inlet end 158 and a discharge end 160. Toward the inlet end 158 of the mixer 20, the mixer frame 156 is equipped with wheels 162 and toward the discharge end 160 the mixer frame 156 has a hitch 164 for transporting the mixer 20. For operating the mixer 20, the mixer frame 156 is supported on stands 166 with the inlet end 158 higher than the discharge end 160. Manually-operated jacks 168 are connected to the mixer frame 156 for erecting the mixer 20 into the operating position.

The mixer drum 154 is supported for rotation upon the mixer frame 156 by a pair of trunnion assemblies 170. A motor with chain and sprocket assembly 172 drives the rotation of the mixer drum 154 about its longitudinal axis.

Aggregate, recycle material and dust are introduced into the mixer drum 154 through an inlet opening (not shown) at the inlet end 158 of the mixer drum 154 by the drag conveyor 46. Asphalt product is discharged from the mixer drum 154 through a discharge opening 174 of a discharge breeching assembly 176 at the discharge end 160 of the mixer drum 154.

A pipe assembly 178 (in dashed lines) extends into the mixer drum 154 at the discharge end 160. The pipe assembly 178 carries bituminous liquid from the reservoir 22 into the mixer drum 154. If a pneumatic dust system is used, dust is typically injected into the mixer drum 154 through a pipe (not shown) running substantially parallel to the pipe assembly 178 for the bituminous liquid.

A burner 56 with combustion fan 182 is positioned at the discharge end 160 of the mixer drum 154 to supply heat to the aggregate, recycle material, dust and bituminous liquid as the mixing process takes place. The mixer burner 56 may have a heating capacity of up to 50 million BTU and its heat is directed into a ceramic fiber-lined tube 184 (in dashed lines) extending from the discharge end 160 of the mixer drum 154 toward the inlet end 158 of the mixer drum 154.

An exhaust gas breeching assembly 186 communicates with the mixer drum 154 at the upper inlet end 158 of the mixer drum 154. An exhaust return duct 188 extends from the exhaust breeching assembly 186 to the return fan assembly 85 of the dryer 14 to carry the exhaust gases of the mixer drum 154 into the dryer drum 62. The exhaust gases of the mixer 20 are introduced into the hot gases of the parallel burner 36 at the end of the combustion chamber 92 or into the hot gases of the counterflow burner 40 at the end of the combustion chamber 94 of the dryer 14 to incinerate unburned hydrocarbons and impurities in the exhaust gases from the mixer 20.

The interior of the mixer drum 154 includes suitable flights (as schematically illustrated as 189) for lifting, veiling and guiding material in the mixer drum 154. Suitable mixer flights are disclosed in U.S. Pat. No. 4,174,181 issued Nov. 13, 1979 in the name of Garbelman et al., which is hereby incorporated by reference.

FIG. 10 also shows the discharge end 42 of the dryer 14 with a Y-shaped duct 190 between the dryer 14 and the drag conveyor 46. One leg 192 of the Y-shaped duct 190 feeds aggregate from the discharge breeching assembly 83 of the dryer 14 into the drag conveyor 46. The other leg 194 communicates with a recycle chute 195 connected to the recycle conveyor 52 for delivery of recycle material into the drag conveyor 46.

Figure 11:
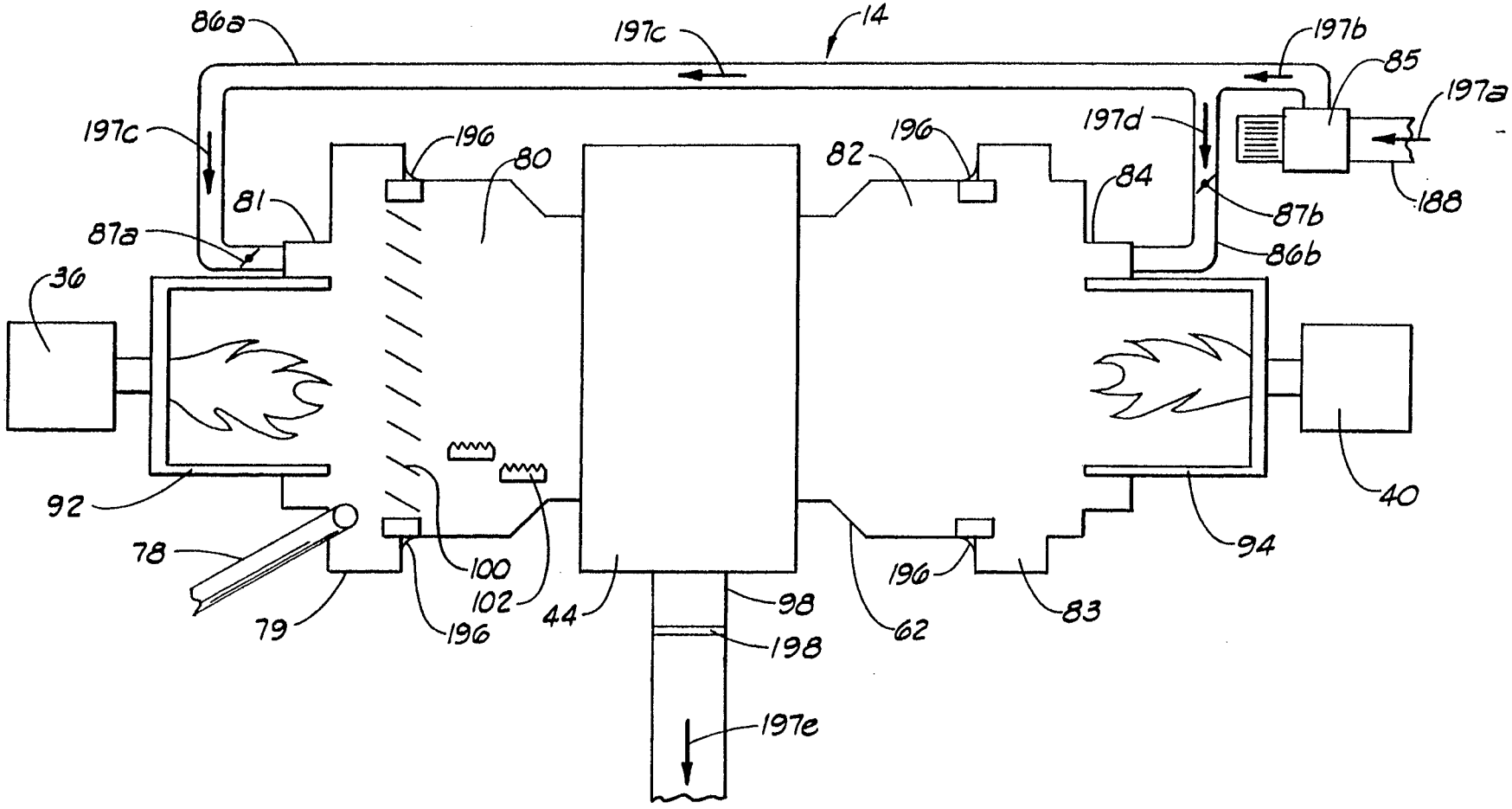
FIG. 11 is a schematic view of the dryer of FIG. 1.

Referring now to FIG. 11, the control of air and exhaust gases in the dryer drum 62 is schematically illustrated. In order to achieve efficient combustion, a high degree of air and exhaust gas flow control is essential. The dryer drum 62 is a substantially closed vessel with virtually no communication to the outside environment. Both ends of the dryer drum 62 are enclosed with the combustion chambers 92 and 94. Furthermore, elastomeric seals 196 are attached to intake breeching assembly 79 and discharge breeching assembly 83, which are stationary, to engage the outer surface of the rotating dryer drum 62 and reduce leakage. The burners 36 and 40 are total air burners, such that virtually the only air introduced into the dryer drum 62 enters through the burners 36 and 40.

Continuing to refer to FIG. 11, mixer exhaust gases are drawn out of the mixer 20 by the return fan 85 through the return duct 188 (as indicated by direction arrow 197*a*). Direction arrow 197*b* designates the flow of mixer exhaust gases out of the discharge end of the return fan 85. The mixer exhaust gases then split, with a portion going to the inlet end return plenum 81 (designated by direction arrows 107*c*) and the rest going to the discharge end return plenum 84 (indicated by direction arrow 197*d*). Note that the mixer exhaust gases are returned through the return plenums 81 and 84 around the respective combustion chambers 92 and 94, and not directly into the flames of the burners 36 and 40. Accordingly, the mixer exhaust gases and accompanying impurities are incinerated in the hot gases produced by the flames of the burners 36 and 40 and not in the flames themselves. In this manner, the mixer exhaust does not adversely affect combustion by being directly introduced into the flames. Moreover, a wide range of materials may be used as recycle material in the mixer 20 without regard to the pollutants generated by their use because the mixer exhaust gases are returned to the dryer 14 to be vaporized. Returning the mixer exhaust into the dryer 14 allows a wide range of materials to be used as recycle material in the mixer 20. Materials which produce smoke and impurities when heated and mixed with a bituminous liquid can be utilized because the smoke and impurities are incinerated in the dryer 14. Finally, FIG. 11 also shows the exhaust gases of the dryer drum 62 exiting from the dust chamber 44 to the baghouse 16 (as indicated by direction arrow 197*e*).

As disclosed hereinabove, the dryer 14 is adapted to for changing the inclination of the dryer drum 62 while the dryer 14 is being operated to dry aggregate. Because the baghouse 16 is a rigid structure, the connecting duct 15 between the dryer 14 and the baghouse 16 must be capable of accommodating the movement of the dryer 14.

As shown in FIG. 1, a flexible coupling 198 is provided within the connecting duct 15 proximate to the dust chamber 44 of the dryer 14 and another flexible coupling 198 is installed within the connecting duct 15 near the entry to the baghouse 16. The flexible couplings 198 are provided in the connecting duct 15 to adjust to changes in the slope of the dryer 14.

Figure 12:
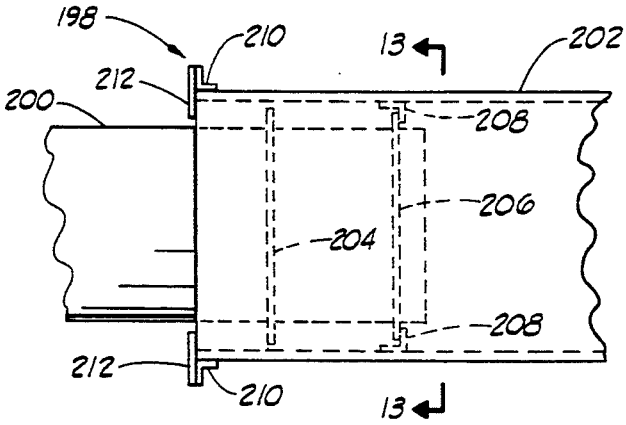
FIG. 12 is a side elevation of a portion of the connecting duct of FIG. 1, illustrating a flexible coupling in the connecting duct.
Figure 13:
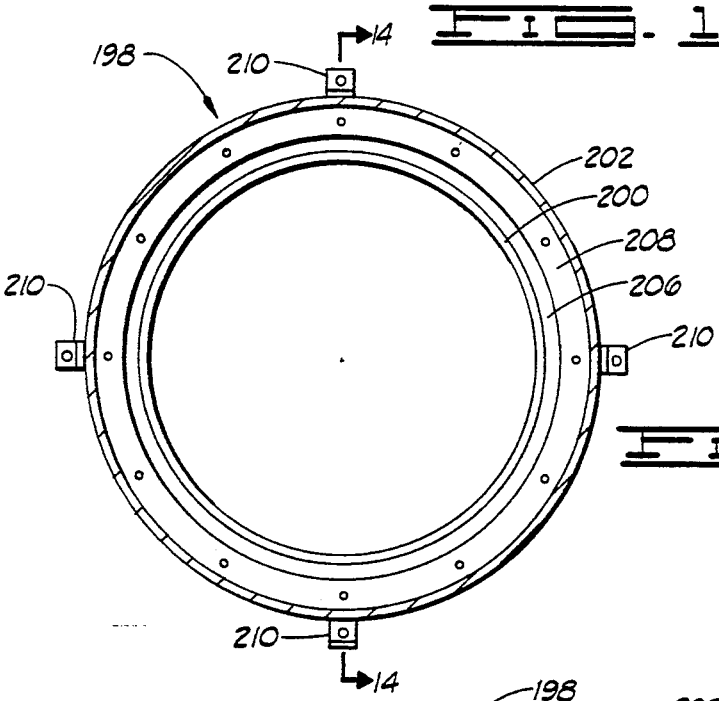
FIG. 13 is a cross-sectional view taken along lines 13—13 of FIG. 12.
Figure 14:
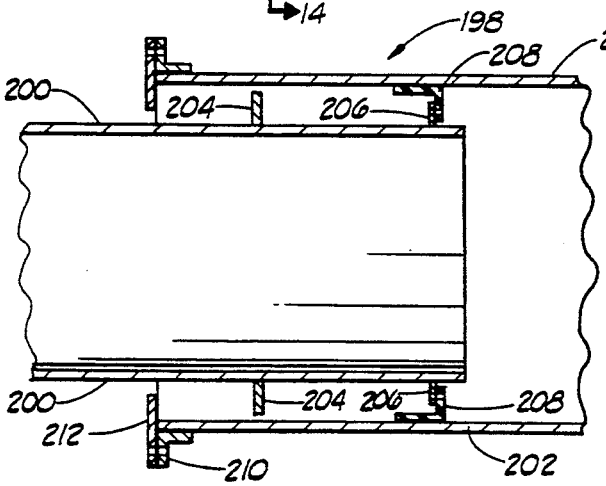
FIG. 14 is a cross-sectional view taken along lines 14—14 of FIG. 13.

FIGS. 12 through 14 illustrate the construction of one of the flexible couplings 198. As shown in these figures, an inside duct 200 is inserted into an outside duct 202. A supporting plate 204 is welded around a medial portion of the inside duct 200 and a mounting plate 206 is welded around an end portion of the inside duct 200. An elastomeric ring 208 is bolted to the mounting plate 206. As best shown in FIGS. 12 and 14, the diameter of the elastomeric ring 208 is greater than the inner diameter of the outside duct 202. Accordingly, the elastomeric ring 208 is bent over to fit within the outside duct 202. The engagement of the elastomeric ring 208 with the inner wall of the outside duct 202 forms a seal which prevents leakage out of the flexible coupling 198.

The flexible coupling 198 also includes a plurality of retaining clips 210 which are welded to the outer periphery of the outside duct 202 at the open end of the outside duct 202. As best shown in FIGS. 12 and 14, the retaining clips 210 are L-shaped in cross-section and a retaining plate 212 is bolted to each retaining clip 210. In the case of an abnormal force tending to dislocate the inside duct 200 from within the outside duct 202, the retaining plates 212 engage the supporting plate 204 to maintain the connection of the ducts 200 and 202.

In operation, the ducts 200 and 202 have a range of movement to adjust for changes in their relative positions. Movement of the ducts 200 and 202 is accommodated while maintaining the connection and seal between the ducts 200 and 202. It is important for the elastomeric ring 208 to maintain sealing engagement between the inside duct 200 and the outside duct 202 to prevent leakage. Elimination of leakage is essential to the efficient handling and control of air and exhaust gases.

Figure 15:
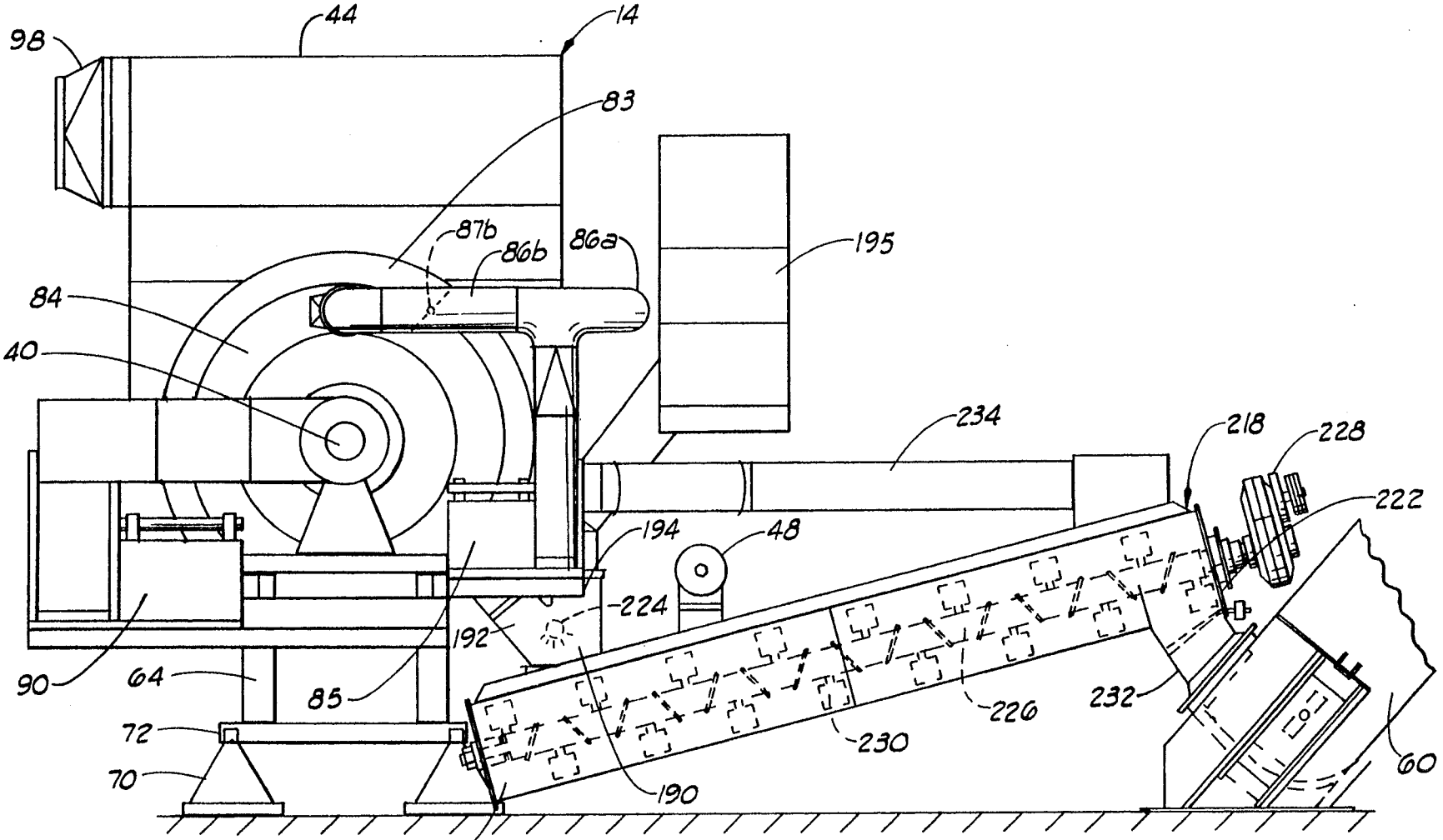
FIG. 15 is a side view of a mixing auger with an end view of the dryer, illustrating another embodiment of an asphalt production plant constructed in accordance with the present invention.

FIG. 15 illustrates another preferred embodiment of an asphalt production plant constructed in accordance with the present invention. In this particular embodiment, the mixer 20 is replaced by a conventional mixing auger 218. The mixing auger 218 has an inlet end 220 and a discharge end 222. The Y-shaped duct 190 communicates with the mixing auger 218 toward the inlet end 220 to introduce aggregate and, if desired, recycle material into the mixing auger 218. The dust screw conveyor 48 also communicates with the mixing auger 218 to deliver dust from the exhaust system 16. A pipe assembly 224 injects bituminous liquid from the reservoir 22 into the mixing auger 218. If no recycle material is used, the bituminous liquid may be injected within the Y-shaped duct 190 as shown in FIG. 15 in order to mix aggregate and the bituminous liquid for the entire length of the mixing auger 218. If recycle material is utilized, however, it is typical to inject the bituminous liquid after the recycle material has been heated by contact with the aggregate.

The mixing auger 218 includes an auger shaft 226 driven by a motor 228 to move material from the inlet end 220 to the discharge end 222 of the mixing auger 218. A plurality of mixing paddles, one of which is designated by reference number 230, extend from the auger shaft 226 to mix the aggregate, bituminous liquid and recycle material while being moved through the mixing auger 218. A discharge duct 232 of the mixing auger 218 communicates with the drag conveyer 60, which carries the asphalt product to the asphalt bin 24.

Much like the previously disclosed embodiment utilizing the drum mixer 20, an exhaust return duct 234 extends from the mixing auger 218 to the return fan 85 of the dryer 14. Gases produced by mixing the hot aggregate with the bituminous liquid and recycle material are introduced into the dryer 14 to be incinerated.

OPERATION

In the operation of the asphalt production plant 10, plant functions are monitored and controlled in the control house 26. Conventional process monitoring and control systems (not shown) are provided to start and stop conveyors and motors, to open and close gates and valves, and to vary the intensity of burner flames. A variety of monitoring and control arrangements are well known to those skilled in the art, and any such arrangement may be utilized with the asphalt production plant 10. Various devices for weighing and sampling aggregate, recycle material and asphalt, also known in the art, may be designed into the asphalt production plant 10.

Before beginning to produce asphalt, the parallel burner 36 and the counterflow burner 40 of the dryer 14 are ignited to preheat the dryer drum 62. Once the dryer drum 62 has been sufficiently heated, the aggregate feed system 12 is started to feed aggregate into the inlet end 38 of the dryer 14.

As the dryer drum 62 is rotated, the aggregate travels from the inlet end 38 of the dryer 14 to the discharge end 42 of the dryer 14. The inlet end 38 of the dryer 14 is positioned to be higher than the discharge end 42. Accordingly, the length of time that the aggregate is resident within the dryer drum 62 is determined by the slope of the dryer drum 62 from the inlet end 38 to the discharge end 42. The slope of the dryer 14, and thus the resident time of the aggregate in the dryer drum 62, may be adjusted from the control house 26 while the dryer drum 62 is rotating by raising or lowering the hydraulic leg assemblies 74 of the dryer 14.

The dryer 14 operates at a negative pressure with the exhaust system 16 drawing exhaust gases from the dryer drum 62 through the dust chamber 44. The velocity of exhaust gases exiting conventional drums is a limiting factor in the capability of such drums. The dryer drum 62 has increased exhaust capacity because the dryer drum 62 communicates with the dust chamber 44 through the slots 130 which have a greater cross-sectional area than the dryer drum adjacent thereto. For example, the cross-sectional area of the slots 130 may be three times the cross-sectional area of the dryer drum adjacent thereto. The increased exhaust gas exit area afforded by the dryer slots 130 and perforated angle plates 132 allows the dryer 14 to operate at a higher production rate without exceeding operating limits for exhaust gas exit velocities.

As the dryer 14 operates, it is desirable to balance the air flow through the dryer drum 62. Because there is air flow from the parallel combustion air assembly 88 at the inlet end 38 and from the counterflow combustion air assembly 90 at the discharge end 42, balancing air flow is more difficult than with single burner drums. The dividing wall 148 and pivoting damper 149 cooperate to assist in balancing air flow through the dryer drum 62. Pressure sensors are typically located at each end of the dryer drum 62 and displayed in the control house 26 by means of a conventional remote monitoring and control system. The position of the damper 149 may be adjusted through the monitoring and control system to achieve and sustain equal negative pressures at the inlet end 38 and discharge end 42 of the dryer drum 62. The positions of the return dampers 87*a* and 87*b* may also be remotely monitored and controlled in the control house 26 to balance the plant 10.

The exhaust system 16 continuously receives exhaust gases from the dust chamber 44 and removes dust particles and pollutants from the exhaust gases. The dust collected by the exhaust system 16 may be disposed of or may be introduced into the asphalt mix by the dust screw conveyor 48.

Upon reaching a predetermined moisture content, the aggregate is transferred out of the discharge breeching assembly 83 of the dryer 14 into the drag conveyor 46. If recycle material is to be added to the mix, the recycle feed assembly 18 delivers recycle material to the drag conveyor 46. The aggregate and recycle material enter the Y-shaped duct 190 communicating with the drag conveyor 46.

The drag conveyor 46 feeds the aggregate, recycle material and dust into the inlet end 158 of the drum mixer 20. Bituminous liquid is pumped into the mixer 20 from the reservoir 22 and is released into the mixer drum 154 through the pipe assembly 178. The bituminous liquid is typically maintained at a heated temperature in the reservoir 22. As the mixer drum 154 is rotated, the bituminous liquid coats the aggregate and recycle material to produce asphalt. A mixer burner 56 may be provided to supply heat to the mixing process. If a burner 56 is utilized with the mixer 20, a ceramic fiber-lined tube 184 is positioned in the mixer drum 154 around the flame of the burner 56.

The mixer 20 is supported by stands 166 with the inlet end 158 of the mixer drum 154 higher than the discharge end 160. The resident time of the aggregate and recycle material in the mixer drum 154 is determined by the slope of the mixer drum 154 from the inlet end 158 to the discharge end 160.

The hot mix asphalt exits the mixer drum 154 through the discharge opening 174 of the discharge breeching assembly 176 to the drag conveyor 60, which carries the asphalt to the asphalt bin 24. The asphalt bin 24 dispenses the hot mix asphalt as needed into transport trucks driven under the asphalt bin 24.

Exhaust gases from the mixer drum 154 are drawn by the return fan 85 through exhaust return duct 188 into the return plenums 81 and 84 of the dryer 14. From the return plenums 81 and 84 the mixer exhaust gases are drawn through the hot gases of the parallel burner 36 and counterflow burner 40 to incinerate impurities entrained in the mixer exhaust gases.

The operation of the asphalt production plant 10 with the mixing auger 218 is very similar to operation with the drum mixer 20. Aggregate and, if desired, recycle material are introduced into the inlet end 220 of the mixing auger 218 through the Y-shaped duct 190. Moving toward the discharge end 222 of the mixing auger 218, bituminous liquid is injected through pipe assembly 224 and dust from the dust screw conveyor 48 is introduced into the mixing auger 218. The rotating paddles 230 mix the aggregate and recycle material with bituminous liquid to produce hot mix asphalt. The asphalt is discharged into the drag conveyor 60, carried to the asphalt bin 24 and dispensed to trucks as described hereinabove.

The mixing of hot aggregate, bituminous liquid and recycle material generates gases within the mixing auger 218. The return duct 234 of the mixing auger 218 carries gases from the mixing auger 218 into the return plenums 81 and 84 of the dryer drum 14. The gases from the mixing auger 218 are routed into the hot gases of the parallel burner 36 and/or counterflow burner 40 to incinerate the gases and impurities entrained in the gases.

An asphalt production plant 10 constructed in accordance with the present invention obtains efficient combustion by using a closed dryer drum 62 with heat input at both ends of the drum. Providing the combustion chambers 92 and 94 to shield the burner flames from aggregate and mixer exhaust promotes complete combustion and fuel efficiency. The plant 10 achieves expanded exhaust gas capacity by providing the dryer drum 62 with slots communicating with the dust chamber 44 to augment the total exhaust gas exit area of the dryer drum 62. The increased exhaust gas exit area provides for greater exhaust gas capacity without exceeding exhaust gas velocity limits.

Changes may be made in the combinations, operations and arrangements of the various parts and elements described herein without departing from the spirit and scope of the invention as defined in the following claims.

What is claimed is:

1. An apparatus for producing asphalt, the apparatus comprising:

a dryer drum having an inlet end, a discharge end, an inner periphery, and a longitudinal axis, the longitudinal axis extending between the inlet end and the discharge end thereof;

means for rotating the dryer drum about the longitudinal axis thereof;

parallel burner means for producing a parallel flame in the dryer drum, the parallel flame extending from the inlet end of the dryer drum toward the discharge end of the dryer drum;

counterflow burner means for producing a counterflow flame in the dryer drum, the counterflow flame extending from the discharge end of the dryer drum toward the inlet end of the dryer drum;

aggregate feed means for conveying aggregate into the inlet end of the dryer drum;

means for mixing the heated aggregate discharging from the dryer drum with a bituminous liquid to produce asphalt mix, the means for mixing having an inlet end and a discharge end;

means for transferring aggregate from the discharge end of the dryer drum into the inlet end of the means for mixing;

means for discharging asphalt mix from the discharge end of the means for mixing;

a dust chamber surrounding a medial dust section of the dryer drum, the dust section of the dryer drum having a plurality of slots therethrough;

a plurality of angle plates mounted to the dust section of the dryer drum, each angle plate covering one of the slots through the dust section of the dryer drum and having a solid side and a perforated side;

a return duct extending between the means for mixing and the dryer drum;

an exhaust system communicating with the dust chamber at an exit opening from the dust chamber, the exhaust system having an exhaust fan for drawing exhaust gases out of the dryer drum and into the exhaust system, wherein the exhaust fan draws exhaust gases out of the means for mixing through the return duct and into the dryer drum to incinerate exhaust gases from the means for mixing in the dryer drum;

a dividing wall extending across at least a portion of the dust chamber to define a forward section of the dust chamber to receive dust-laden exhaust gas primarily from the combustion of the parallel flame and a rear section of the dust chamber to receive dust-laden exhaust gas primarily from the combustion of the counterflow flame; and a damper pivotally attached to the dividing wall proximate to the exit opening of the dust chamber;

wherein the damper pivots to balance exhaust gas flow through the forward section of the dust chamber with exhaust gas flow through the rear section of the dust chamber as exhaust gas is drawn from the dryer drum through the dust chamber and into the exhaust gas system.

2. An apparatus for producing asphalt, the apparatus comprising:

a dryer drum having an inlet end, a discharge end, an inner periphery, and a longitudinal axis, the longitudinal axis extending between the inlet end and the discharge end thereof;

means for rotating the dryer drum about the longitudinal axis thereof;

parallel burner means for producing a parallel flame in the dryer drum, the parallel flame extending from the inlet end of the dryer drum toward the discharge end of the dryer drum;

counterflow burner means for producing a counterflow flame in the dryer drum, the counterflow flame extending from the discharge end of the dryer drum toward the inlet end of the dryer drum;

aggregate feed means for conveying aggregate into the inlet end of the dryer drum;

means for mixing the heated aggregate discharging from the dryer drum with a bituminous liquid to produce asphalt mix, the means for mixing having an inlet end and a discharge end;

means for transferring aggregate from the discharge end of the dryer drum into the inlet end of the means for mixing; means for discharging asphalt mix from the discharge end of the means for mixing;

a dust chamber surrounding a medial dust section of the dryer drum, the dust section of the dryer drum having a plurality of slots therethrough;

a plurality of angle plates mounted to the dust section of the dryer drum, each angle plate covering one of the slots through the dust section of the dryer drum and having a solid side and a perforated side;

a return duct extending between the means for mixing and the dryer drum; end an exhaust system communicating with the dust chamber and having an exhaust fan for drawing exhaust gases out of the dryer drum and into the exhaust system, wherein the exhaust fan draws exhaust gases out of the means for mixing through the return duct and into the dryer drum to incinerate exhaust gases from the means for mixing in the dryer drum;

wherein the apparatus is characterized further to include a plenum connected to the dryer drum and communicating with the annulus between the counterflow combustion chamber and the interior surface on the dryer drum, and wherein said return duct communicates with said plenum, whereby the exhaust gas from the means for mixing contacts the hot gases from the counterflow burner downstream from the counterflow combustion chamber.

3. An apparatus for producing asphalt, the apparatus comprising:

a dryer drum having an inlet end, a discharge end, an inner periphery, and a longitudinal axis, the longitudinal axis extending between the inlet end and the discharge end thereof;

means for rotating the dryer drum about the longitudinal axis thereof;

parallel burner means for producing a parallel flame in the dryer drum, the parallel flame extending from the inlet end of the dryer drum toward the discharge end of the dryer drum;

counterflow burner means for producing a counterflow flame in the dryer drum, the counterflow flame extending from the discharge end of the dryer drum toward the inlet end of the dryer drum;

aggregate feed means for conveying aggregate into the inlet end of the dryer drum;

means for mixing the heated aggregate discharging from the dryer drum with a bituminous liquid to produce asphalt mix, the means for mixing having an inlet end and a discharge end;

means for transferring aggregate from the discharge end of the dryer drum into the inlet end of the means for mixing;

means for discharging asphalt mix from the discharge end of the means for mixing;

a dust chamber surrounding a medial dust section of the dryer drum, the dust section of the dryer drum having a plurality of slots therethrough;

a plurality of angle plates mounted to the dust section of the dryer drum, each angle plate covering one of the slots through the dust section of the dryer drum and having a solid side and a perforated side;

a return duct extending between the means for mixing and the dryer drum; and an exhaust system communicating with the dust chamber and having an exhaust fan for drawing exhaust gases out of the dryer drum and into the exhaust system, wherein the exhaust fan draws exhaust gases out of the means for mixing through the return duct and into the dryer drum to incinerate exhaust gases from the means for mixing in the dryer drum;

wherein the apparatus is characterized further to include a plenum connected to the dryer drum and communicating with the annulus between the parallel flow combustion chamber and the interior surface on the dryer drum, and wherein said return duct communicates with said plenum, whereby the exhaust gas from the means for mixing contacts the hot gases from the parallel flow burner downstream from the parallel flow combustion chamber.

4. An asphalt production plant comprising:

a rotatable dryer drum having an inlet end, a discharge end and an internal passageway extending between the inlet end and the discharge end thereof, said dryer drum being adapted to urge aggregate material through the internal passageway from the inlet end to the discharge end thereof;

a first burner positioned within said dryer drum to direct a first stream of hot gases into the internal passageway of said dryer drum from the inlet end toward the discharge end of said dryer drum;

a second burner positioned within said dryer drum to direct a second stream of hot gases into the internal passageway of said dryer drum from the discharge end toward the inlet end of said dryer drum;

a dust chamber circumscribing a medial section of said dryer drum and communicating with the internal passageway of said dryer drum to receive exhaust gases from said first and second burners;

exhaust means, communicating with said dust chamber, for drawing the first burner exhaust gases and the second burner exhaust bases out of said dryer drum through said dust chamber;

mixing means for coating aggregate material with a bituminous liquid to produce asphalt product, said mixing means communicating with the discharge end of said dryer drum to receive aggregate material from said dryer drum; and flow control means for adjusting the relative proportion of first burner exhaust gases and second burner exhaust gases being drawn out of said layer drum by said exhaust means.

5. The asphalt production plant of claim 4 wherein said dust chamber and said dryer drum define a space therebetween for increased exhaust gas capacity.

6. The asphalt production plant of claim 4 further comprising:

a baghouse separator communicating with said dust chamber, said baghouse separator being adapted to receive exhaust gases from said dryer drum and to remove dust from the exhaust gases from said dryer drum.

7. The asphalt production plant of claim 6 further comprising:

a dust auger communicating with said baghouse separator and said mixing means, said dust auger being adapted to transfer dust out of said baghouse separator and into said mixing means.

8. The asphalt production plant of claim 4 further comprising:

a dust communicating with said dust chamber and said mixing means, said dust auger being adapted to transfer dust out of said dust chamber and into said mixing means.

9. The asphalt production plant of claim 4 wherein said mixing means comprises a mixing auger.

10. An asphalt production plant comprising:

a rotatable dryer drum having an inlet end, a discharge end and an internal passageway extending between the inlet end and the discharge end thereof, said dryer drum being adapted to urge aggregate material through the internal passageway from the inlet end to the discharge end thereof;

a first burner positioned within said dryer to direct a first stream of hot gases into the internal passageway of said dryer drum from the inlet end toward the discharge end of said dryer drum;

a second burner positioned within said dryer drum to direct a second stream of hot gases into the internal passageway of said dryer drum from the discharge end toward the inlet end of said dryer drum;

a dust chamber circumscribing a medial section of said dryer drum and communicating with the internal passageway of said dryer drum to receive exhaust gases from said first and second burners;

exhaust means, communicating with said dust chamber, for drawing the first burner exhaust gases and the second burner exhaust bases out of said dryer drum through said dust chamber; and mixing means for coating aggregate material with a bituminous liquid to produce asphalt product, said mixing means communicating with the discharge end of said dryer drum to receive aggregate material from said dryer drum;

wherein said mixing means comprises a rotatable mixer drum having an inlet end, a discharge end and an internal passageway extending from the inlet end to the discharge end thereof.

11. The asphalt production plant of claim 10 further comprising:

a mixer burner directing a stream of hot combustion gases into the internal passageway of said mixer drum from the discharge end toward the inlet end of said mixer drum.

12. An asphalt production plant comprising:

a rotatable dryer drum having an inlet end, a discharge end and an internal passageway extending between the inlet end and the discharge end thereof, said dryer drum being adapted to urge aggregate material through the internal passageway from the inlet end to the discharge end thereof;

a first burner positioned within said dryer drum to direct a first stream of hot gases into the internal passageway of said dryer drum from the inlet end toward the discharge end of said dryer drum;

a second burner positioned within said dryer drum to direct a second stream of hot gases into the internal passageway of said dryer drum from the discharge end toward the inlet end of said dryer drum;

a dust chamber circumscribing a medial section of said dryer drum and communicating with the internal passageway of said dryer drum to receive exhaust gases from said first and second burners;

exhaust means, communicating with said dust chamber, for drawing the first burner exhaust gases and the second burner exhaust gases out of said dryer drum through said dust chamber;

mixing means for coating aggregate material with a bituminous liquid to produce asphalt product, said mixing means communicating with the discharge end of said dryer drum to receive aggregate material from said dryer drum; and mixer exhaust means, communicating with said mixing means and said dryer drum, for drawing exhaust gases out of said mixing means and into said first burner of said dryer drum to incinerate particles entrained in the exhaust gases from said mixing means.

13. An asphalt production plant comprising:

a rotatable dryer drum having an inlet end, a discharge end and an internal passageway extending between the inlet end and the discharge end thereof, said dryer drum being adapted to urge aggregate material through the internal passageway from the inlet end to the discharge end thereof;

a first burner positioned with said dryer drum to direct a first stream of hot gases into the internal passageway of said dryer drum from the inlet end toward the discharge end of said dryer drum;

a second burner positioned within said dryer drum to direct a second stream of hot gases into the internal passageway of said dryer drum from the discharge end toward the inlet end of said dryer drum;

a dust chamber circumscribing a medial section of said dryer drum and communicating with the internal passageway of said dryer drum to receive exhaust gases from said first and second burners;

exhaust means, communicating with said dust chamber, for drawing the first burner exhaust gases and the second burner exhaust gases out of said dryer drum through said dust chamber;

mixing means for coating aggregate material with a bituminous liquid to produce asphalt product, said mixing means communicating with the discharge end of said dryer drum to receive aggregate material from said dryer drum; and mixer exhaust means, communicating with said mixing means and said dryer drum, for drawing exhaust gases out of said mixing means and into said second burner of said dryer drum to incinerate particles entrained in the exhaust gases from said mixing means.

* * * * *

UNITED STATES PATENT AND TRADEMARK OFFICE

CERTIFICATE OF CORRECTION

PATENT NO.: 5,397,177

DATED: March 14, 1995

INVENTOR(S): Swisher, Jr.

It is certified that error appears in the above-identfied patent and that said Letters Patent is hereby corrected as shown below:

Title page, item[57] Abstract line 15, after "bituminous", "fluid" should be --liquid--.

Title page, item [57] Abstract line 23, after "asphalt", "tom" should be --from--.

Column 8, line 47, after "arrows", "107c" should be --197c--.

Column 13, line 55, after ";", a new paragraph should begin with the second occurrence of the word "means".

Column 13, line 66, "end" should be --and--.

Column 15, line 35, "layer" should be --dryer--.

Column 15, line 55, after "dust", insert --auger--.

Column 16, line 1, after "dryer", insert --drum--.

Column 16, line 15, "bases" should be --gases--.

Column 17, line 8, after "positioned", "with" should be --within--.

Signed and Sealed this

Twenty-sixth Day of September, 1995

*Attest:*

Bruce Lehman

BRUCE LEHMAN

*Attesting Officer*

*Commissioner of Patents and Trademarks*